United States Patent [19]

Doke

[11] Patent Number: 4,938,185

[45] Date of Patent: Jul. 3, 1990

[54] ENGINE COOLING ARRANGEMENT

[75] Inventor: Katsuji Doke, Yokohama, Japan

[73] Assignee: Nissan Motor Co., Ltd., Yokohama, Japan

[21] Appl. No.: 275,190

[22] Filed: Nov. 23, 1988

[30] Foreign Application Priority Data

Nov. 26, 1987 [JP] Japan ..... 62-180184[U]

[51] Int. Cl.[5] ..... F02F 7/00

[52] U.S. Cl. ..... 123/195 C; 123/41.08; 123/41.44

[58] Field of Search ..... 123/41.08, 41.09, 41.1, 123/41.29, 41.44, 195 C, 198 E; 236/34.5; 165/35, 36

[56] References Cited

U.S. PATENT DOCUMENTS

| | | | |
|---|---|---|---|
| 1,406,922 | 2/1922 | Boyce | 123/41.08 |
| 2,353,231 | 2/1944 | Ginn | 123/41.44 |
| 4,212,270 | 7/1980 | Nakanishi et al. | 123/41.44 |

FOREIGN PATENT DOCUMENTS

| | | |
|---|---|---|
| 59-184318 | 12/1984 | Japan . |
| 60-147716 | 10/1985 | Japan . |

*Primary Examiner*—Noah P. Kamen

*Attorney, Agent, or Firm*—Pennie & Edmonds

[57] ABSTRACT

An engine cooling arrangement including a coolant pump for recirculating coolant in an engine cooling system, and a thermostat for thermally controlling coolant flow in the cooling system. The engine cooling arrangement is comprised of a one-piece structure formed with chambers for the coolant pump and the thermostat and coolant flow passageways. The one-piece structure is formed integral with a timing cover secured to the front face of a cylinder block of an engine to cover a timing chain or the like, thereby omitting joints and therefore requiring no fastening member and gasket.

8 Claims, 2 Drawing Sheets

ENGINE COOLING ARRANGEMENT

BACKGROUND OF THE INVENTION

1. Field of the Invention

This invention relates to improvements in an engine cooling arrangement forming part of a cooling system of an internal combustion engine, and more particularly to such an arrangement including a coolant pump and a thermostat for controlling flow of coolant.

2. Description of the Prior Art

Automotive internal combustion engines are usually provided with an engine cooling system including a coolant pump and a thermostat for thermally controlling coolant flow through a radiator. A variety of engine cooling systems have been proposed and put into practical use. One of them is as shown in FIG. 1, in which a thermostat 1 is installed to a transmission while a coolant pump 2 is installed at the front end section of a cylinder block 3. Coolant from a radiator and that from a heater supplied to the thermostat 1, respectively, through pipes 4 and 5. Heated coolant from a coolant jacket of the cylinder block flows through a conduit 6 to the radiator and through a pipe 7 to the heater. Coolant from the thermostat 1 flows into the coolant pump 2. As shown, a coolant pipe 8 is provided to fluidly connect the thermostat and the coolant pump 2. The reference numeral 9 designates a bypass pipe for fluidly connecting the thermostat 1 and the cylinder block coolant jacket.

With such an arrangement, the thermostat 1 and the coolant pump 2 are separate and independent from each other. This requires the relatively long coolant pipe 8 and bypass pipe 9 and additionally hose clamps and the likes while increasing the number of steps in an assembly process for an engine cooling system.

Another one of the engine cooling systems is as shown in FIG. 2, in which the thermostat 1' and the coolant pump 2' are previously assembled as a unit and installed to the cylinder block. Coolant from the radiator is fed through the pipe 5' to the thermostat 1'. Heated coolant from the cylinder block coolant jacket flows through the conduit 6' and the pipe 7' respectively to the radiator and the heater. Coolant from the heater is fed through the pipe 4' to the thermostat 1'.

In order to obtain the thus previously assembled thermostat 1' and coolant pump 2' as a unit, a core is required for casting a block formed with a coolant passageway communicating the thermostat and the coolant pump. This renders difficult production of the block with aluminum die casting.

SUMMARY OF THE INVENTION

It is an object of the present invention is provide an improved engine cooling arrangement including a thermostat and a coolant pump, which arrangement does not require fastening means and gaskets for joints of component parts while facilitating assembly of the arrangement.

Another object of the present invention is to provide an improved engine cooling arrangement in which chambers for coolant pump and thermostat and coolant flow passageways are formed in a block integral with a timing cover attached to the front face of a cylinder block of an internal combustion engine.

The engine cooling arrangement of the present invention comprises first, second and third sections which are formed integral with a timing cover secured to the front face of a cylinder block of an internal combustion engine. The first section defines a chamber in which at least a part of a coolant pump is disposed. The second section defines a coolant inlet passageway through which coolant flows into the coolant pump. The coolant inlet passageway accommodates therein a heat sensor section of a thermostat and therefore serves as chamber for the heat sensor section. The third section defines a coolant outlet passageway through which coolant flows out from said coolant pump.

Thus, the chambers accommodating the coolant pump and the thermostat and the coolant flow passageways are formed in a one-piece structure formed integral with the timing cover, and therefore there is no joint in the engine cooling arrangement. This does not require fastening means and gaskets for joints, thereby reducing the number of component parts thus to lower a production cost while improving operational efficiency in an assembly process.

Additionally, since the overhang of a housing of the thermostat is made smaller, the width of the engine can be suppressed smaller therby making the engine small-sized and light in weight. The smaller overhang prevents engine accessories from being demaged due to interference with the overhang under vibration, thus improving durability of the engine.

Furthermore, if the coolant passageway connecting the thermostat and the coolant pump is formed straight and shorter, the engine cooling arrangement can be produced of aluminum die casting, thereby greatly reducing the number of steps in a production process.

BRIEF DESCRIPTION OF DRAWINGS

In the drawings, like reference numerals designate like parts and elements throughout all figures, in which.

DETAILED DESCRIPTION OF THE INVENTION

Figure 1:
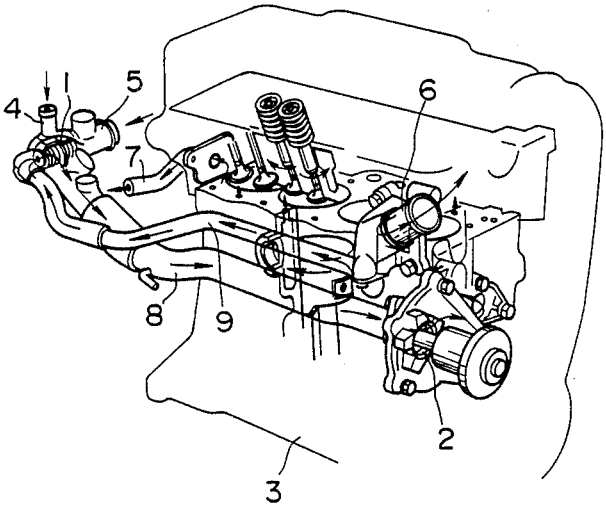
FIG. 1 (PRIOR ART)
FIG. 1 is a schematic perspective illustration of a conventional engine cooling arrangement forming part of a cooling system of an internal combustion engine.
Figure 2:
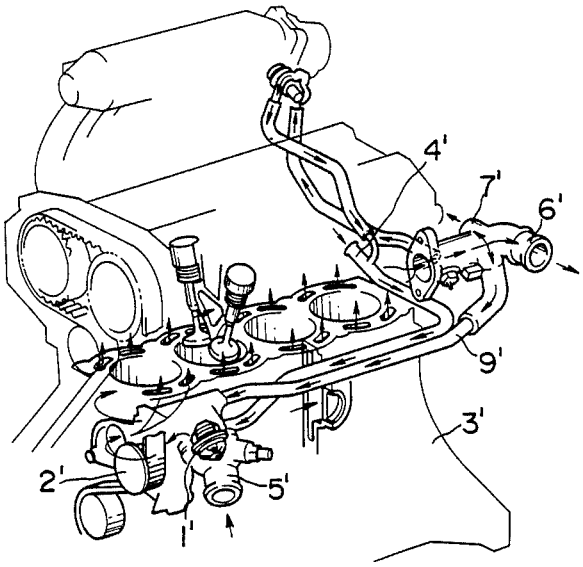
FIG. 2 (PRIOR ART)
FIG. 2 is a schematic perspective illustration of another conventional engine cooling arrangement forming part of a cooling system of an internal combustion engine.
Figure 3:
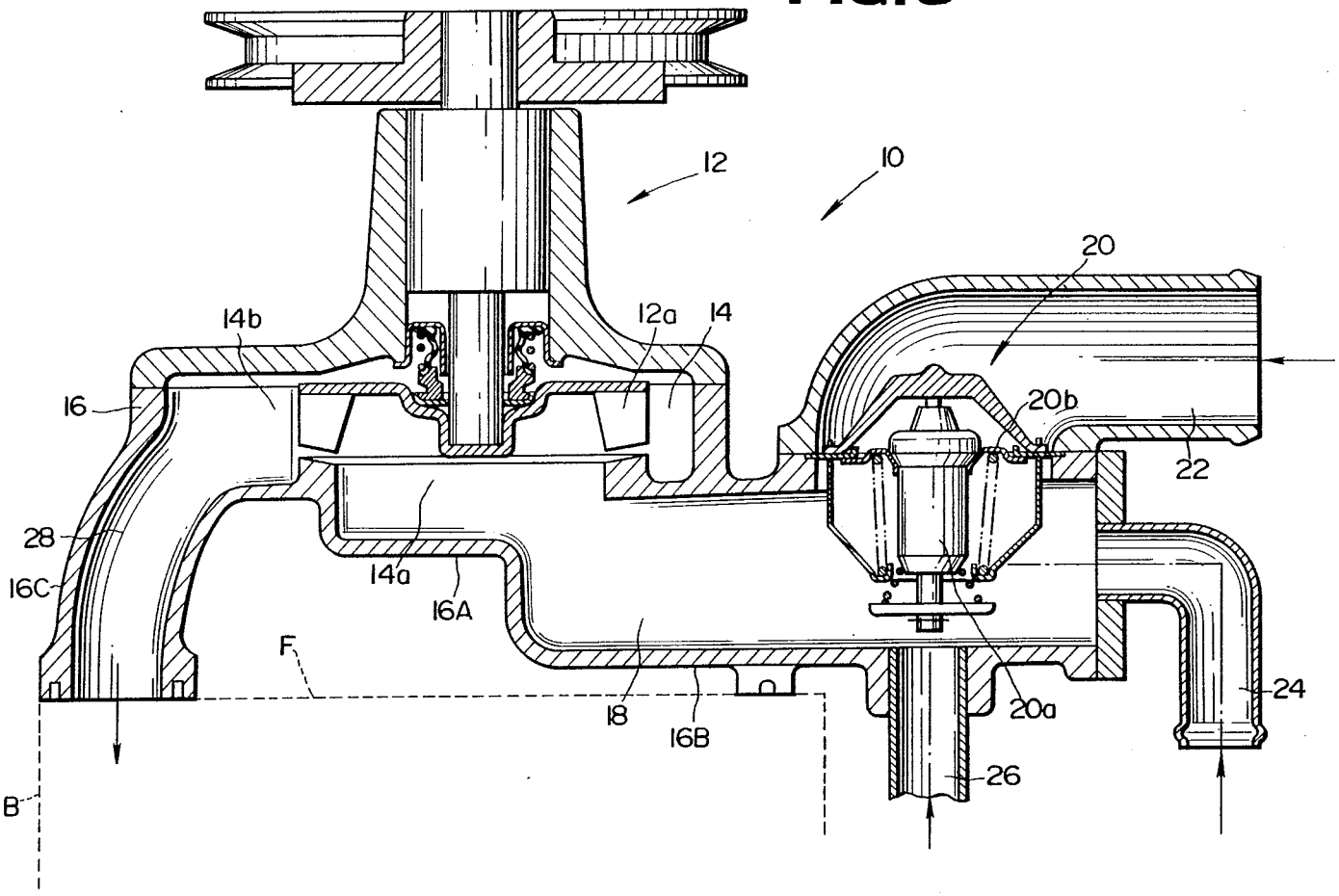
FIG. 3 is a cross-sectional view of an embodiment of an engine cooling arrangement in accordance with the present invention.

Referring now to FIG. 3, an embodiment of an engine cooling arrangement according to the present invention is illustrated by the reference numeral 10. The engine cooling arrangement 10 forms part of an engine cooling system (not shown) in which cooling water or engine coolant is recirculated through a water or coolant jacket in a cylinder block B of an automotive internal combustion engine. The cooling arrangement 10 comprises a water or coolant pump 12 whose impeller **12*a* is rotatably housed in an impeller chamber 14. The impeller chamber 14 is defined in an impeleler chamber section 14A integral with and forming part of a timing (front) cover 16. It will be understood that the pump impeller 12*a* is driven through a pulley (not identified) by a crankshaft (not shown) of the engine. The timing cover 16** is fixedly secured to the front face F of the front end section of the cylinder block B to cover timing gears, timing chains, or a cogged belt for transmitting rotation of the crankshaft of a camshaft (not shown) of the engine.

A water or coolant inlet passageway 18 leads to or communicates with the inlet 14a of the impeller chamber 14 and defined in an inlet passageway section 6B which is integral with and forms part of the timing cover 16. A thermostat 20 is provided to thermally control the flow of the cooling water from a radiator (not shown) to the water jacket of the cylinder block. The thermostat 20 has a heat sensor section 20a which is disposed in the inlet passageway 18. Accordingly, the inlet passageway 18 serves also as a chamber for accomodating the heat sensor section 20a. In this embodiment, the inlet passageway 18 is formed straight so as to have a straight axis (not shown) which is perpendicular to the axis of the water pump 12. A water or coolant passageway 22 leading from the radiator is communicable through the thermostat 20 with the inlet passageway 18 so that cooling water from the radiator is suppliable to the inlet passageway 18 when a valve section 20b of the thermostat 20 opens. Another water or coolant passageway 24 leading from a heater (not shown) is communicated with the inlet passageway 18. The heater is fluidly connected with the water jacket of the cylinder block B though not shown. Additionally, a bypass passageway 26 is provided to connect the water jacket of the cylinder block B with the inlet passageway 18.

A water or coolant outlet passageway 28 is formed to communicate with the outlet 14b of the pump impeller chamber 14 and communicate with the water jacket of the cylinder block B. The outlet passageway 28 is defined in an outlet passageway section 16C which is integral with and forms part of the timing cover 16. As shown, the inlet passageway section 16B and the outlet passageway section 16C are fixedly secured to the front face F of the cylinder block B.

Whit the thus configurated engine cooling arrangement, cooling water from the radiator is suppliable through the thermostat valve section 20b into the inlet passageway 18 and thereafter sucked into the pump impeller chamber 14. Then, cooling water discharged from the water pump 12 is recirculated through the outlet passageway 28 to the water jacket of the cylinder block B. Cooling water discharged from the cylinder block water jacket is fed to the radiator and the heater. It will be understood that, when the engine is cold, cooling water discharged from the cylinder block water jacket is recirculated to the inlet passageway 18 bypassing the radiator in order to promote warm-up of the engine.

As discussed above, the inlet passageway 18 serving also as the chamber for accommodating the thermostat heat sensor section 20a is formed in the inlet passageway section 6B on the inlet side of the water pump 12, while the outlet passageway 28 is formed in the outlet passageway section 6C on the outlet side of the water pump 12. The inlet and outlet passageway sections 16B, 16C are integrally formed with the timing cover 16 as forming part of the timing cover. Accordingly, there is no joint in a cooling water passageway line from the thermostat 20 to the downstream side of the water pump 12, thereby omitting gaskets and fastening means for joint.

Additionally, since the inlet passageway 18 serving also as the thermostat accommodating chamber is formed straight, the timing cover 16 with the sections 16A, 16B and 16C can be produced by casting using an outer mold without using a core. Thus, the timing cover 16 with the sections 16A, 16B and 16C can be easily produced by die-casting, thereby simplifying production process of the engine.

Since the thermostat heat sensor section 20a is accomodated in the cooling water inlet passageway 18, overhang of a housing section for the thermostat 20 is minimized, thereby reducing the width of the engine while making the engine cooling system small-sized.

What is claimed is:

1. An engine cooling arrangement comprising:

a timing cover secured to a front face of a cylinder block of an internal combustion engine to cover a part of a valve operating mechanism;

a first section defining a chamber and formed integral with said timing cover;

a coolant pump at least partially disposed in said chamber;

a second section defining a coolant inlet passageway through which coolant flows to said coolant pump, said second section being formed integral with said timing cover, said second section being directly integral with said first section so that said coolant inlet passageway is directly connected to said chamber, said second section extending generally straight so that said coolant inlet passageway extends generally straight in a manner to enable said second section to be produced by die-casting;

a thermostat having a heat sensor section disposed in said coolant inlet passageway; and a third section defining a coolant outlet passageway through which coolant flows from said coolant pump, said third section being formed integral with said timing cover, said third section being directly integral with said first section so that said coolant outlet passageway is directly connected to said chamber, said third section extending toward said cylinder block of said engine to define a space between said cylinder block and said engine cooling arrangement.

2. An engine cooling arrangement as claimed in claim 1, wherein said timing cover integral with said first, second and third sections are formed of aluminum die casting.

3. An engine cooling arrangement as claimed in claim 1, wherein said second section extending generally straight so that said coolant inlet passageway extends generally straight.

4. An engine cooling arrangement as claimed in claim 3, wherein axis of said second section is parallel with front face of the cylinder block.

5. An engine cooling arrangement as claimed in claim 4, wherein the axis of said second section is generally perpendicular to axis of said coolant pump.

6. An engine cooling arrangement as claimed in claim 1, wherein said third section is attached to front face of the cylinder block so that said coolant outlet passageway communicates with a coolant jacket of the cylinder block.

7. An engine cooling arrangement comprising:

a timing cover secured to a front face of a cylinder block of an internal combustion engine to cover a part of a valve operating mechanism;

a first section defining a chamber and formed integral with said timing cover;

a coolant pump at least partially disposed in said chamber;

a second section defining a coolant inlet passageway through which coolant flows to said coolant pump, said second section being formed integral with said timing cover, said second section being directly integral with said first section so that said coolant inlet passageway is directly connected to said chamber, said second section extending generally straight so that said coolant inlet passageway extends generally straight, said coolant inlet passageway being tapered toward said first section to enable said second section to be produced by die-casting, said coolant inlet passageway being opened to form an opening at an end opposite to said chamber of said first section;

a cover member for closing said coolant passageway opening;

a thermostat having a heat sensor section disposed in said coolant inlet passageway; and a third section defining a coolant outlet passageway through which coolant flows from said coolant pump, said third section being directly integral with said first section so that said coolant outlet passageway is directly connected to said chamber, said third section being formed integral with said timing cover, said third section extending toward said cylinder block of said engine to define a space between said cylinder block and said cooling arrangement.

8. An engine cooling arrangement comprisigng:

a one-piece structure produced by die-casting and including a timing cover secured to front face of a cylinder block of an internal combustion engine to cover a part of a valve operating mechanism, a first section defining a chamber and formed integral with said timing cover, a second section defining a coolant inlet passageway through which coolant flows to said coolant pump, said timing cover, said second section being directly integral with said first section so that said coolant inlet passageway is directly connected to said chamber, said second section extending generally straight so that said coolant inlet passageway extends generally straight, said coolant inlet passageway being tapered toward said first section, said coolant inlet passageway being opened to form an opening at an end opposite to said chamber of said first section, and a third section defining a coolant outlet passageway through which coolant flows from said coolant pump, said third section being directly integral with said first section so that said coolant outlet passageway is directly connected to said chamber, said third section being formed integral with said timing cover, said third section extending toward said cylinder block of said engine to define a space between said cylinder block and said engine cooling arrangement;

a coolant pump at least partially disposed in said chamber of said first section chamber;

a cover member for closing said coolant passageway opening of said third section; and a thermostat having a heat sensor section disposed in said collant inlet passageway of said second section.

* * * * *